United States Patent. [19]

Wallis

[11] Patent Number: 4,971,240

[45] Date of Patent: Nov. 20, 1990

[54] METHOD AND APPARATUS FOR FORMING HEAT EXCHANGER TUBES

[76] Inventor: Bernard J. Wallis, 2215 Dacosta, Dearborn, Mich. 48128

[21] Appl. No.: 439,824

[22] Filed: Nov. 21, 1989

[51] Int. Cl.[5] ..... B23K 13/02; B23K 101/06

[52] U.S. Cl. ..... 228/146; 228/147; 228/151; 228/173.7; 228/17; 228/17.5; 219/61.2

[58] Field of Search ..... 228/173.1, 173.7, 146, 228/147, 150, 151, 183, 17, 17.5; 219/59.1, 61.2; 72/226, 234, 250

[56] References Cited

U.S. PATENT DOCUMENTS

| | | | |
|---|---|---|---|
| 2,197,963 | 4/1940 | Anderson | 228/17.5 |
| 2,613,303 | 10/1952 | Babbitt | 228/17.5 |
| 4,024,619 | 5/1977 | Jonason | 228/150 |
| 4,558,695 | 12/1985 | Kumazawa et al. | 228/183 |
| 4,562,326 | 12/1985 | Tan et al. | 219/59.1 |
| 4,590,781 | 5/1986 | Toyooka | 228/151 |

FOREIGN PATENT DOCUMENTS

| | | | |
|---|---|---|---|
| 640777 | 1/1979 | U.S.S.R. | 228/150 |

OTHER PUBLICATIONS

Metals Handbook Ninth Edition, vol. 14, pp. 624–635, "Contour Roll Forming", copyright 4–1988.

*Primary Examiner*—Sam Heinrich
*Attorney, Agent, or Firm*—Barnes, Kisselle, Raisch, Choate, Whittemore & Hulbert

[57] ABSTRACT

In a method and apparatus of forming a flat metal strip into a tube having generally flat side walls connected by bight portions along their opposite longitudinal edge portions comprising the steps of directing the strip between a pair of form rolls to bend the opposite longitudinal edge portions of the strip into similar generally upwardly curved edge portions; then directing the strip between a second set of rolls which engage the upwardly curved edge portions to center the strip laterally relative to the rolls and bend the strip along its longitudinal center line to form an upwardly rounded bend therealong while maintaining the portions of the strip on the opposite sides of the center bend relatively flat whereby to impart to the strip a V-shaped cross section having a central apex and oppositely upwardly inclined flat legs, each terminating in a laterally inwardly curved edge; directing the V-shaped strip between one or more additional sets of form rolls to increase the circumferential extend of said apex, decrease the included angle between the legs and thereby displace the inwardly curved edge portions laterally inwardly toward each other into closely spaced, opposed relation and thereafter heating said inwardly curved edge portions and squeezing them laterally together to form a weld seam between the free edges thereof and thereby form the finished tube wherein the seam welded inwardly curved edge portions and said apex form the bight portions of the tube and the legs of the V form the substantially flat side walls of the tube, the improvement comprising directing the strip between a pair of form rolls in advance of the aforementioned first form rolls to first roll the opposite edges of the strip into a configuration comprising flat end portions connected to the central flat portion of the strip by curved portions.

5 Claims, 4 Drawing Sheets

METHOD AND APPARATUS FOR FORMING HEAT EXCHANGER TUBES

This invention relates to a method and apparatus for forming tubes from sheet metal and, more particularly, for forming flat coolant tubes for heat exchangers.

BACKGROUND AND SUMMARY OF THE INVENTION

Coolant tubes for heat exchangers have generally flat side walls connected by rounded bight portions along their opposite longitudinal edges. In a heat exchanger the tubes are arranged interdigitally with corrugated fin strips with the side walls soldered to the successive crests of the fin strips. Such tubes are usually rolled from flat strip stock into tubes of circular cross section which are butt welded along their abutting edges and then flattened into the desired finished shape. This method of forming such tubes has several inherent disadvantages. When the strip stock is rolled into circular shape and then flattened, the metal is subjected to considerable cold working which can result in defects such as cracks in the finished tube. In addition, the strip stock from which such tubes are rolled frequently has a thickness of less than 0.010"; consequently, prior to welding the rolled tube is quite flimsy and flexible and it is very difficult to align the edges exactly in opposed abutting relation for welding.

The primary object of this invention is to provide a method and apparatus for rolling flat metal strip stock into generally flat tubes at a high rate of speed and in a manner which reduces cold working of the metal to a minimum.

A further object of the invention is to provide a tube mill wherein the strip stock is bent along an extremely accurate center line which is thereafter utilized to center the strip as it is directed through the successive forming rolls.

Another object of the invention is to provide a guide mechanism which engages each of the opposed free edges of the strip on laterally opposite sides thereof to maintain them in perfect alignment as the strip is directed through the welding station.

U.S. Pat. No. 4,595,135 is directed to an improved method wherein flat strip stock is rolled into a flat tube while maintaining the side walls of the tube in a generally flat condition throughout the rolling operation. As a result, the metal is subjected to a minimum of cold working. Furthermore, since the side walls of the tube are maintained substantially flat, the cross section of the tube prior to welding presents a relatively rigid structure as compared to a circular cross section. Thus the operation of exactly aligning the opposed free edges for welding is rendered relatively simple More specifically, the method comprises the steps of first rolling the opposite edges of the strip into a curved configuration having a radius corresponding to the radius of curvature desired on the rounded longitudinally welded edge of the tube, then progressively rolling the central portion of the strip into the rounded configuration desired along the other longitudinal edge of the tube while utilizing the rounded free edge portions and the center bend to accurately center the strip as it advances through the successive forming rolls and, thereafter heating the spaced free edges of the rolled strip to a temperature at which they are adapted to be fused together and directing them through a guide located upstream from and directly adjacent a pair of squeeze rolls for effecting a weld seam therebetween, the guide being designed to engage each free edge portion of the strip on laterally opposite sides thereof.

The method and apparatus disclosed in U.S. Pat. No. 4,595,135 has been found to be capable of rolling metal strip stock into generally flat tubes at a high rate of speed and in a manner which reduces cold working of the metal to a minimum; wherein the strip stock is bent along an extremely accurate center line which is thereafter utilized to center the strip as it is directed through the successive forming rolls; and which utilizes a guide mechanism which engages each of the opposed free edges of the strip on laterally opposites sides thereof to maintain them in perfect alignment as the strip is directed through the welding station.

However, it has been found that the guide mechanism must be accurately positioned to guide the flat strip stock into the first rolling step and, unless this is done carefully, the extremely accurate center line will not be maintained. As a result, the final step of welding is made more difficult and a consistently sound weld seam may not be assured.

Accordingly, among the objectives of the present invention are to provide a method and apparatus for rolling flat metal strip stock into generally flat tubes wherein the strip stock is bent along ,an extremely accurate center line without the necessity of carefully positioning and guiding the strip stock into the first step wherein the opposite edges of the strip are rolled into the final radius corresponding to the radius of curvature desired on the rounded longitudinally welded edge of the tube.

In accordance with the invention, an additional rolling step is provided wherein initially the opposite edges of the flat strip are rolled by restraining the free ends of the side edges and bending the side edges into a configuration comprising flat side edge portions connected by a radius portion to the central flat portion of the strip and extending at an acute angle to the flat central portion of the strip This partially curved configuration serves as a guide to accurately position the strip as it moves into the next step of rolling the opposite flat edge portions of the strip into a curved configuration having a radius corresponding to the radius of curvature desired on the rounded longitudinally welded edge of the tube. The strip is then moved through the successive steps of progressively rolling the central portion of the strip into the rounded configuration desired along the other longitudinal edge of the tube while utilizing the rounded free edge portions and the center bend to accurately center the strip as it advances through the successive forming rolls and, thereafter heating the spaced free edges of the rolled strip to a temperature at which they are adapted to be fused together and directing them through a guide located upstream from and directly adjacent a pair of squeeze rolls for effecting a weld seam therebetween, the guide being designed to engage each free edge portion of the strip on laterally opposite sides thereof.

DESCRIPTION

Figure 1:
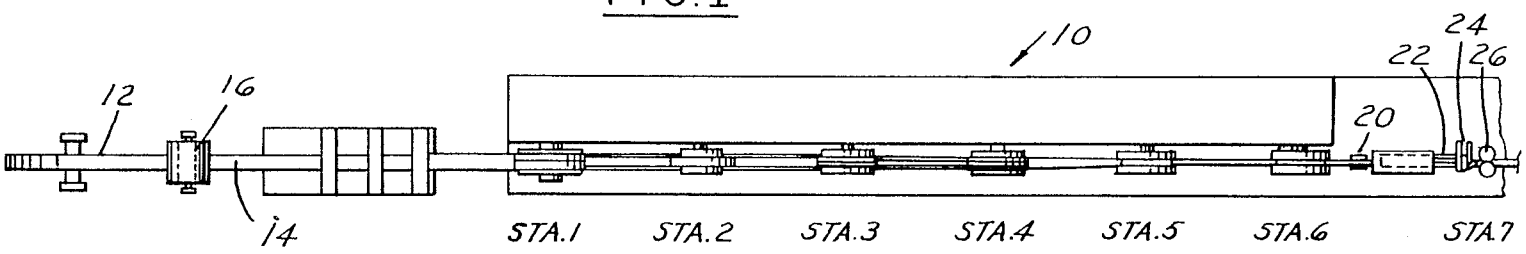
FIGS. 1 and 2 are plan and side elevational views, respectively, of a tube mill according to the present invention.
Figure 2:
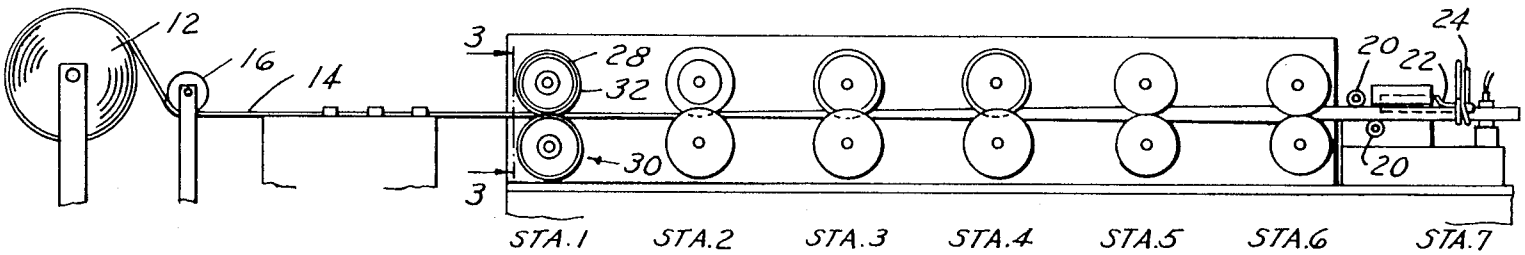
Figure 4:
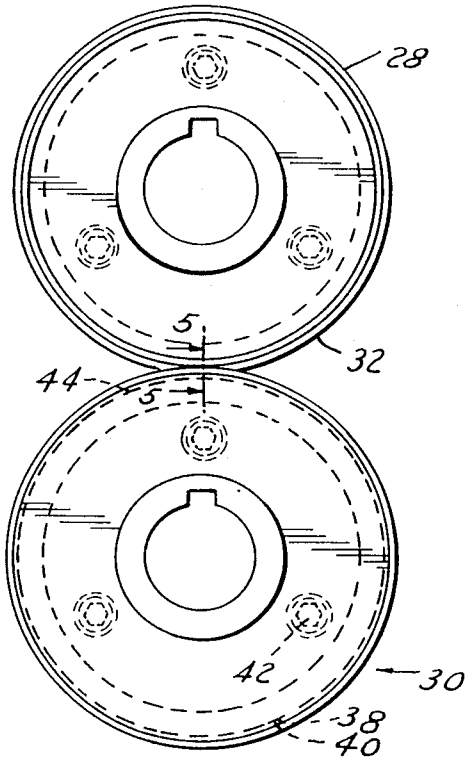
FIG. 4 is an end view of the portion of the tube mill shown in FIG. 3.
Figure 3:
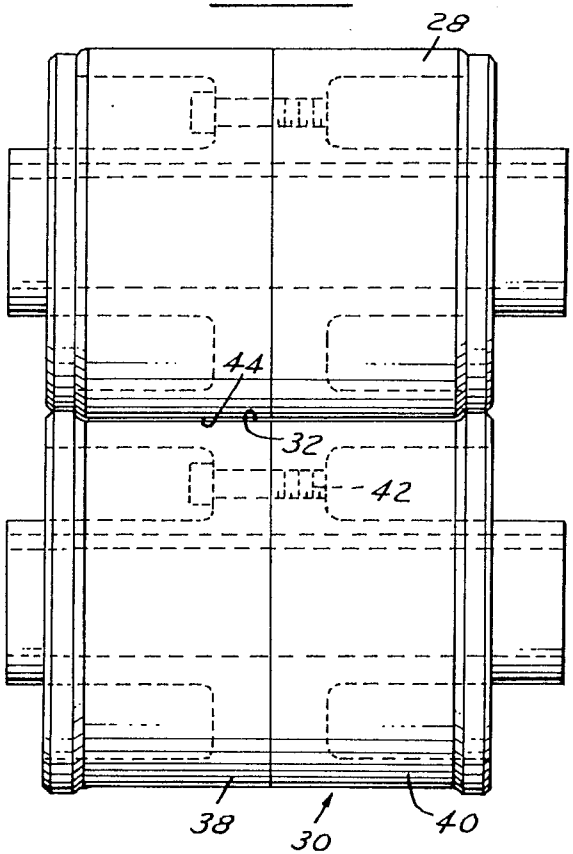
FIG. 3 is a sectional view on an enlarged scale taken along the line 3—3 in FIG. 2.

The tube mill embodying the invention is generally designated 10 in FIGS. 1 and 2 and includes a reel 12 of flat strip stock from which the flattened tube is rolled. The strip stock on reel 12 is of extremely accurate uniform width with squared longitudinal edges. The strip 14 from reel 12 is initially directed around a guide roller 16 and then through a plurality of guides 18 for generally aligning the strip. The strip is then directed through a plurality of sets of cooperating form rolls which, in FIG. 1, are designated stations 1, 2, 3, 4, 5 and 6. After the strip emerges from the form rolls at station 6, it is guided by a pair of vertically spaced guide rolls 20 through a guide member 22, an induction heating coil 24 and then between a pair of squeeze rolls 26 at station 7.

In accordance with the invention, the form rolls at station 1 are illustrated in FIGS. 3–6. The rolls comprise an upper roll 28 and a lower roll 30. Lower roll 30 has a central circular cylindrical portion 32 of uniform radius which is centered laterally with respect to the strip directed through the guides 18. At laterally opposite ends thereof the central portion 32 has a radially outwardly flat fillet 34 which merges with central portion 32 by a curved port 36. To facilitate the manufacture thereof the lower roll 30 is formed as two separate rings 38,40 which are secured together as by screws 42. Accurate alignment of the two rings is assured by seating ring on the cylindrical flange of ring.

The upper roll 28 at station 1 also has a circular cylindrical central portion 44 which, at its laterally opposite ends, has a flat portion 39 which merge smoothly with central portion 44 through a curved portion 46.

Figure 5:
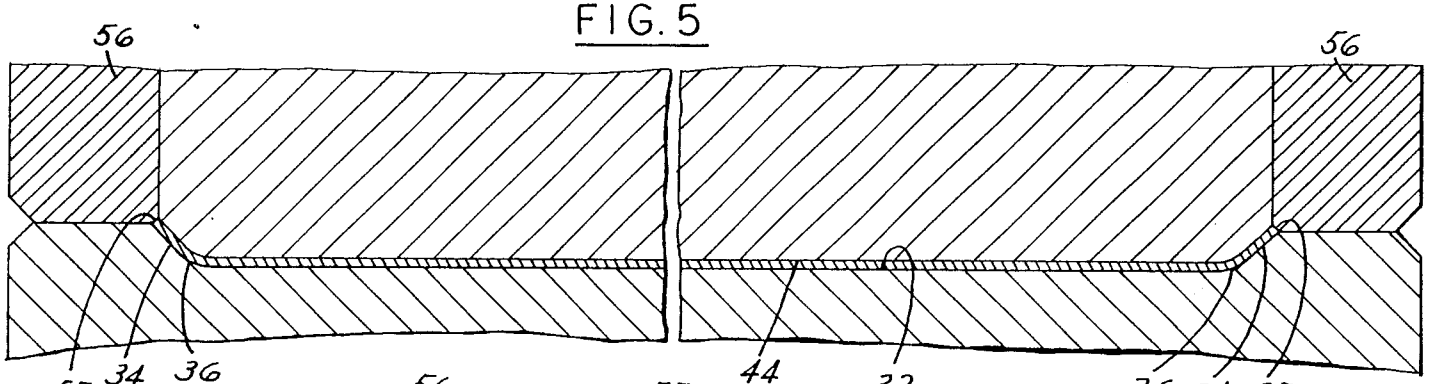
FIG. 5 is a fragmentary sectional view on an enlarged scale taken along the line 5—5 in FIG. 4.
Figure 6:
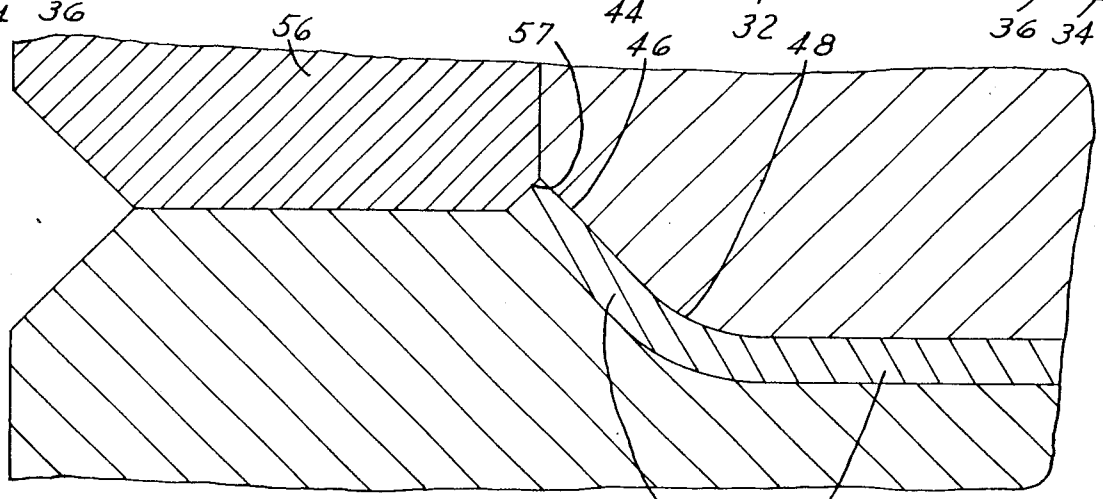
FIG. 6 is a fragmentary enlarged sectional view of the left-hand portion of FIG. 5.
Figure 7:
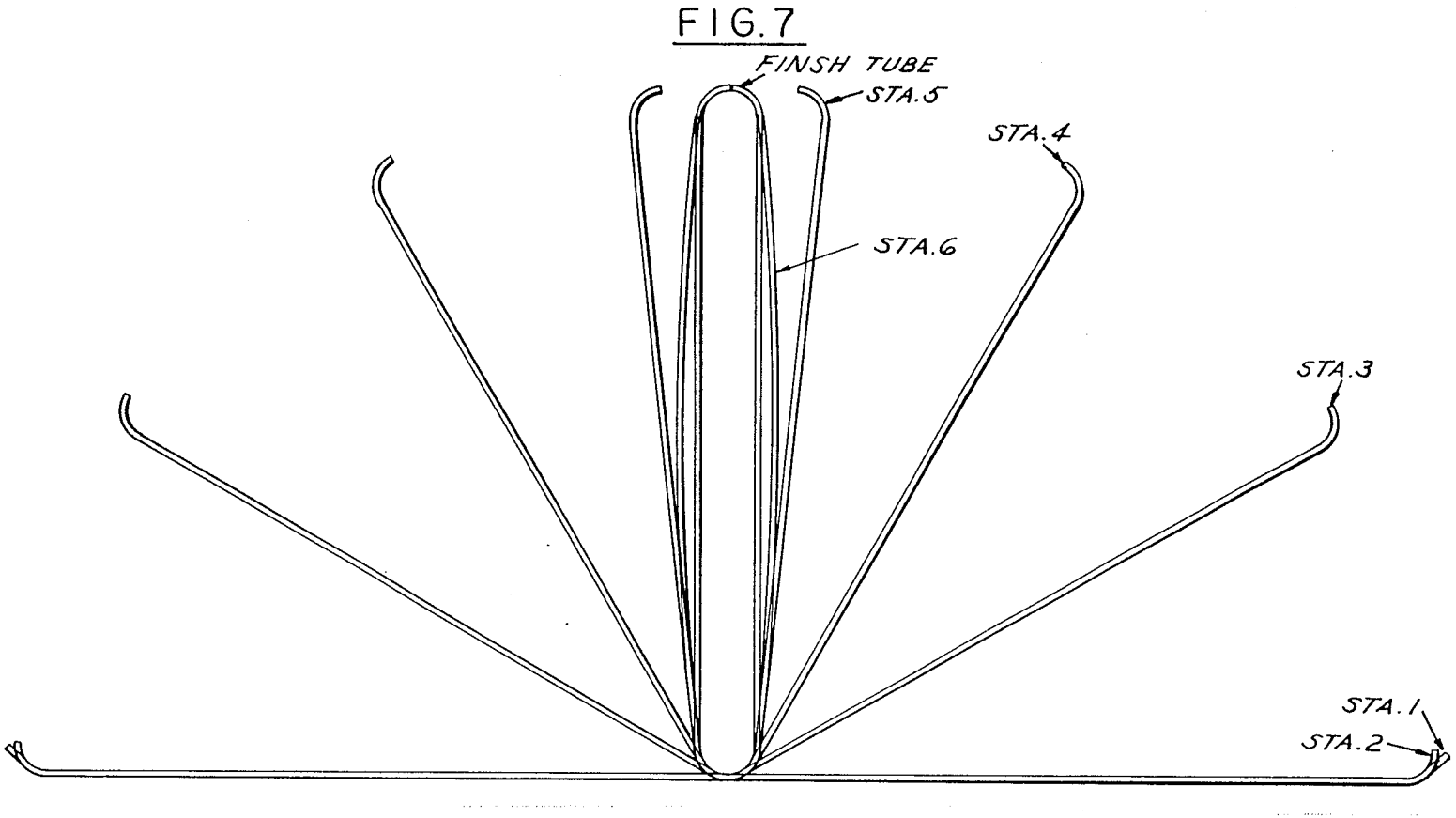
FIG. 7 is a schematic view showing the progressive cross sectional configuration of the strip stock as it is formed into the finished tube.

Rolls 28,30 are arranged in mating relation so that the central portion 32 of roll 30 registers axially with the central portion 44 of roll 28 and is spaced therefrom a distance corresponding to the thickness of strip 14. Roll 28 includes flattened surfaces 46 which extend at acute angles spaced from and concentric with the flattened surfaces 34 on roll 30 which extend at a complementary acute angle. An additional roll 56 is associated with the upper roll 28 and has a flattened surface 57 at an acute angle which restrains the adjacent free edge of the strip to restrain the strip. When the strip is directed between rolls 28,30, the laterally outer edge portions 54 of strip 14 are bent to a configuration such that as the strip 14 emerges from between rolls 28,30, it has a flat central portion 55 with upwardly extending flat edge portions 54 that extend at an acute angle along the laterally opposite sides as the strip emerges from station 1 thereof as shown in FIGS. 5, 6 and 7.

The subsequent forming of the strip at stations 2–7 is achieved substantially in the same way as set forth in U.S. Pat. No. 4,595,135, which is incorporated herein by reference. However it has been found that the additional step of forming the strip at station 1 into a configuration comprising flat end portions connected to the central flat portion of the strip by curved portions obviates the need for accurate guiding of the flat strip to the first station.

Thus, the rolls at station 2 have a flat central portion and rounded corners which cooperate to roll the edges of the strip to a radius corresponding to the radius of a curvature desired on the rounded longitudinally welded edge of the tube.

The rolls at station 3 comprise an upper roll and a lower roll. The lower roll is formed around its periphery with a V-shaped groove having an accurately centered rounded apex from which extend a pair of radially outwardly flaring conical surfaces which terminate at their outer ends in radially outwardly curved shoulders. The radius of curvature of shoulders corresponds to the radius of curvature imparted to the laterally outer edge portions of strip 14 by the rolls at station 2.

The rolls at station 4 comprise an upper roll and a lower roll. The ring construction and assembly of these two rolls is generally the same as the rolls at station 3. The difference lies primarily in the fact that the central apex of the V-shaped groove on the lower roll has the same radius, but a greater circumferential extent and the outer periphery of the central portion on the upper roll is defined in cross section by a circular arc having a circumferential extent of about 180°. Likewise, the conical surfaces on rolls the are inclined to the vertical at a steeper angle than the previous pair of rolls so that the included angle between these legs is substantially less than the included angle as the strip emerges from rolls. In addition, the strip is accurately centered laterally between the rolls not only by the interengagement of the accurately centered apex with the accurately centered portions of rolls, but also by rounded shoulders on the upper roll which engage the laterally outer surfaces of the rounded edge portions of the strip. Here again, the conical surfaces of the roll are merely in rolling contact with the extreme free edges of the curved edge portions at laterally opposite sides of the strip.

As shown in FIG. 7, it is apparent that the configuration of the strip imparted by rolls involves an increase in the circumferential extent of the rounded apex of the V-shaped configuration of the strip so that the included angle between the two flat legs has been reduced substantially. The angle preferably lies in the range of between 25° to 30°.

The form rolls at station 5 of the mill comprise an upper roll and a lower roll. As in the case of the previously described form rolls, the rolls are spaced vertically apart in parallel relation The lower roll has a central V-shaped groove around its outer periphery defined by an accurately centered rounded apex and slightly curved side walls. The upper roll is likewise formed with a V-shaped groove around its outer periphery which is defined by an accurately centered rounded apex and slightly curved side walls. The apex on the lower roll differs slightly in configuration from the apex in that the apex is a continuous curve having a predetermined radius corresponding to the radius desired of the bight portion of the finished tube opposite the welded edges. On the other hand, the apex on the upper roll comprises two curved sections having a radius corresponding to the radius of apex separated by a central cylindrical portion of uniform radius. The depth of the grooves in the rolls is such that, as the formed strip is directed between these rolls, it is compressed in a direction radially of the rolls so that the flat side walls of the strip are previously formed are caused to bulge outwardly into contact with the curved surfaces of the rolls and the circumferential extent of the rounded apex is increased so that the now slightly curved side walls of the tube are spaced much closer together as shown in FIG. 7. It will be noted that although the configuration of the curved free edge portions is not altered, the extreme free edges of these curved portions are still spaced apart slightly after the formed strip emerges from rolls.

The form rolls at station 6 comprise an upper roll and a lower roll formed around their outer periphery with a central groove. The groove in the lower roll is defined by an accurately centered rounded apex having a radius the same as the rounded apex on the lower roll at station 5, but of an even greater circumferential extent, and side walls which are curved to a lesser extent than the side walls. Likewise, the groove in the upper roll is formed with a rounded apex having a central cylindrical portion of uniform radius and curved portions having their same radius as the curved portions, but having a greater circumferential extent. Likewise, the side walls of the groove formed in the upper roll are only slightly curved. The side walls of the grooves in rolls of station 6 are spaced closer together than the side walls of the grooves in the rolls of station 5 and the radial extent of these grooves is slightly greater. Thus, the formed tube as it emerges from rolls (FIG. 7) has its side walls flatter and spaced closer together than the side walls of the tube as formed by the rolls at station 5 and the rounded opposite ends of the tube have a greater circumferential extent. It will be noted however that the grooves in the rolls are shaped and dimensioned such that the formed tube emerging from these rolls still has the extreme free edges of the strip spaced apart slightly in opposed relation.

As the formed tube emerges from the rolls at station 6, it is vertically supported and guided between the vertically spaced guide rolls 20. Roll 20 is located at the upstream end of guide 22. Guide 22 is preferably constructed as set forth in the aforementioned patent and comprises a ceramic block of highly durable material. The under side of the guide is formed with a pair of opposed guide tracks. At the upstream end of guide 22 the opposed side faces of the guide are machined to form a pair of vertical flat surfaces which diverge in a downstream direction. Thereafter, the flat vertical surfaces converge in a downstream direction to the downstream end of the guide. The included angle between the converging portions of the flat surfaces preferably lies in the range of 5° to 7°. Adjacent the downstream end of guide 22 the tracks are formed as channels of uniform width, the laterally inner faces of these channels being defined by the flat vertical faces and the laterally outer faces of these channels being defined by flat vertical faces The width of each channel corresponds accurately to the transverse dimension between the free edges of the formed tube and the laterally outer face of the adjacent side wall of the tube. Thus, as the formed tube is directed through guide 22, the curved edge portions are first spread slightly apart and are then converged towards each other by the channels so that each of these edges is closely confined laterally by the channels In view of the fact that the side walls are only slightly curved, it follows that these side walls are quite rigid in a vertical direction as viewed in FIG. 7. Since the bight portion is accurately centered between the free ends, the two side walls have exactly the same vertical dimension. As a consequence, the two extreme free edges of the tube are maintained in accurate horizontal alignment in slightly laterally spaced relation.

The downstream end of guide 22 and the portion of the tube being directed therethrough are encircled by the induction heating coil 24. This coil is water cooled and connected to a source of high frequency current so that as the tube advances therethrough the slightly spaced free edges are immediately heated to a fusion temperature.

Immediately after emerging from the downstream end of guide 22 the tube is directed between the squeeze rolls 26 to produce a weld seam between the fused edges. The details of squeeze rolls 26 are set forth in the aforementioned U.S. patent. Each squeeze roll is journalled on a vertically extending shaft and is cooled through a liquid conduit. Each squeeze roll 26 is formed around the outer periphery thereof with a recessed cylindrical portion having annular rounded shoulders around the upper and lower edges thereof. The radii of shoulders correspond with the radii of the free edge portions 54 on the rounded strip and the rounded bight portion along the opposite longitudinal edge of the tube. The recessed cylindrical portion has only a slight concave curvature, less than the curvature of the walls imparted to the tube as it emerges from between the rolls. The squeeze rolls are spaced apart such that, when the tube with the heated edges is directed therebetween, the side walls are squeezed together and flattened to cause the free edges to be brought into pressure engagement and thereby form the weld seam. As shown in FIG. 7, the side walls of the finished tube are generally flat and parallel. As a practical matter, the squeeze rolls 26 are shaped such that in a tube having a total vertical dimension of about $\frac{5}{8}$" the side walls have a very slight, visually imperceptible curvature. The walls are spaced apart at the vertically central portion thereof about 0.002" further than adjacent the rounded bight portions of the tube.

With the above described arrangement a perfectly formed tube with respect to the weld and the size and cross sectional shape of the tube, can be formed at the rate of 10 feet or more per second. The accuracy in the cross sectional shape of the tube and the soundness of the weld seam is attributable to several important features incorporated in the arrangement. In the first place, it will be noted that subsequent to the initial guides 18 the free edges of the strip are not subjected to frictional sliding engagement with other components and, particularly, with surfaces on the form rolls. This is extremely important because, in order to obtain a perfect weld seam at a high rate of speed, it is imperative that the edges to be welded remain perfectly flat and free of burrs or other surface roughness. In the above described arrangement the strip is accurately centered as it is directed between the successive form rolls by causing the form rolls to engage the laterally outer sides of the strip, particularly the laterally outer sides of the edge portions, rather than the free edges. In this manner perfect horizontal alignment of the abutting edges is obtained and a minimum of cold working is imparted to the strip by rolling it in a manner such that the side walls of the tube remain substantially flat throughout the entire operation. Perfect alignment of the welded edges is also obtained by causing each of the free edge portions to be laterally confined and gradually converged by the channels in guide 22. It will be noted that the downstream end of guide 22 terminates immediately adjacent and on the upstream side of the two squeeze rolls 26. As mentioned previously, the included angle between the channels preferably lies in the range of 5° to 7°. The squeeze rolls are positioned such that the converging straight inner sides of these channels intersect approximately at the point where the two squeeze rolls cause the free edges of the tube to be pressed together. In practice it has been found that when the included angle between channels is about 5°, the downstream end of guide 22 can be located as close as ⅝" from a line connecting the axes of the two squeeze rolls 26. As a consequence, the free edges are laterally confined in accurately aligned relation until just momentarily before they are welded together. In this manner a consistently sound weld seam is assured.

It can thus be seen that the provision of an additional forming step in advance of forming the opposite edges of the strip into a configuration comprising flat end portions connected to the central flat portion of the strip by curved portions obviates the need for accurate guidance of the tube to the second station wherein the final curved configuration of the opposite edges is formed.

We claim:

1. In a method of forming a flat metal strip into a tube having generally flat side walls connected by bight portions along their opposite longitudinal edge portions comprising the steps of directing the strip between a pair of form rolls to bend the opposite longitudinal edge portions of the strip into similar generally upwardly curved edge portions; then directing the strip between a second set of rolls which engage the upwardly curved edge portions to center the strip laterally relative to the rolls and bend the strip along its longitudinal center line to form an upwardly rounded bend therealong while maintaining the portions of the strip on the opposite sides of the center bend relatively flat whereby to impart to the strip a V-shaped cross section having a central apex and oppositely upwardly inclined flat legs, each terminating in a laterally inwardly curved edge; directing the V-shaped strip between one or more additional sets of form rolls to increase the circumferential extent of said apex, decrease the included angle between the legs and thereby displace the inwardly curved edge portions laterally inwardly toward each other into closely spaced, opposed relation and thereafter heating said inwardly curved edge portions and squeezing them laterally together to form a weld seam between the free edges thereof and thereby form the finished tube wherein the seam welded inwardly curved edge portions and said apex form the bight portions of the tube and the legs of the V form the substantially flat side walls of the tube, the improvement comprising directing the strip between a pair of form rolls in advance of the aforementioned first form rolls to first roll the opposite edges of the strip into a configuration comprising flat end portions connected to the central flat portion of the strip by curved portions.

2. The method set forth in claim 1 wherein said configuration of the opposite edges of the strip comprises a flat edge portion connected by a radius having a length greater than the radius of curvature desired on the rounded longitudinally welded edge of the tube.

3. In a mill for rolling flat metal strip of accurately uniform width into a tube having a pair of generally flat side walls connected along their opposite edges by rounded bight portions, means at the upstream end of the mill for guiding the flat strip in an accurately straight path; a first pair of form rolls in said path downstream from and aligned with said guide means for bending the opposite longitudinal edge portions of the strip into similar upwardly curved edge portions while maintaining the portion of the strip between said edge portions in a flat condition; a second set of form rolls downstream from the first set, one roll of said second set having a peripheral V-shaped groove therein defined by a central rounded apex and opposed surfaces which flare radially outwardly from said apex and terminate in generally radially outwardly extending guide surfaces, the other roll in said second set having an axially central, radially outwardly extending annular rib with a rounded outer periphery in axial section which registers axially with the central rounded apex of said one roll and a pair of annular stop surfaces which extend axially to adjacent said guide surfaces; the axes of the rolls in the second set being spaced apart radially such that, when the strip is directed from between the first set of rolls to between the second set of rolls, the upwardly curved edge portions are engaged on the laterally outer sides thereof by said guide surfaces, the free edges of said curved surfaces are engaged by said stop surfaces and the central portion of the strip is engaged between said annular rib and the rounded apex to bend the strip transversely into a V-shaped cross section having a central rounded apex and upwardly oppositely inclined flat legs each terminating in laterally inwardly curved rounded portions, one or more additional sets of form rolls shaped to increase the circumferential extent of the rounded apex on the strip and decrease the included angle between said legs to an extent such that the free edges of said curved edge portions are displaced toward each other into close proximity in opposed relation and means downstream from said additional rolls for integrally joining said free edges together to form the finished tube, the improvement comprising an additional pair of form rolls between the guide means and the first pair of form rolls, said additional pair of rolls comprising portions engaging said strip, restraining the free ends of the side edges and bending the side edges into a configuraiton comprising flat side edge portions connected by a radius portion to the central flat portion of the strip and extending at an acute angle to the flat central portion of the strip.

4. In a method of forming a flat metal strip into a tube having generally flat side walls connected by bight portions along their opposite longitudinal edge portions comprising the steps of directing the strip between a pair of form rolls to bend the opposite longitudinal edge portions of the strip into similar generally upwardly curved edge portions; then directing the strip between a second set of rolls which engage the upwardly curved edge portions to center the strip laterally relative to the rolls and bend the strip along its longitudinal center line to form an upwardly rounded bend therealong while maintaining the portions of the strip on the opposite sides of the center bend relatively flat whereby to impart to the strip a V-shaped cross section having a central apex and oppositely upwardly inclined flat legs, each terminating in a laterally inwardly curved edge; directing the V-shaped strip between one or more additional sets of form rolls to increase the circumferential extent of said apex, decrease the included angle between the legs and thereby displace the inwardly curved edge portions laterally inwardly toward each other into closely spaced, opposed relation and thereafter heating said inwardly curved edge portions and squeezing them laterally together to form a weld seam between the free edges thereof and thereby form the finished tube wherein the seam welded inwardly curved edge portions and said apex form the bight portions of the tube and the legs of the V form the substantially flat side walls of the tube, the improvement comprising directing the strip between a pair of form rolls in advance of the aforementioned first form rolls to first roll the opposite edges of the strip into a configuration comprising flat end portions connected to the central flat portion of the strip by curved portions.

5. The method set forth in claim 4 wherein said method comprises restraining the free ends of the side edges and bending the side edges into a configuration comprising flat side edge portions connected by a radius portion to the central flat portion of the strip and extending at an acute angle to the flat central portion of the strip.

* * * * *